US009569994B2

(12) United States Patent
Lee

(10) Patent No.: US 9,569,994 B2
(45) Date of Patent: Feb. 14, 2017

(54) DIGITAL DISPLAY DEVICE AND IMAGE ARRANGEMENT METHOD USING THE SAME

(75) Inventor: Ji-Yoon Lee, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 1048 days.

(21) Appl. No.: 12/654,155

(22) Filed: Dec. 11, 2009

(65) Prior Publication Data

US 2011/0025597 A1 Feb. 3, 2011

(30) Foreign Application Priority Data

Jul. 31, 2009 (KR) ..... 10-2009-0070547

(51) Int. Cl.
*G09G 5/00* (2006.01)
*G09G 3/20* (2006.01)

(52) U.S. Cl.
CPC .... *G09G 3/2003* (2013.01); *G09G 2320/0257* (2013.01); *G09G 2340/16* (2013.01)

(58) Field of Classification Search
CPC ..... G09G 5/00
USPC ..... 345/156
See application file for complete search history.

(56) References Cited

U.S. PATENT DOCUMENTS

2005/0083353 A1* 4/2005 Maruyama et al. ..... 345/690
2005/0180641 A1* 8/2005 Clark ..... 382/232
2006/0066914 A1* 3/2006 Niimi et al. ..... 358/448
2006/0268987 A1 11/2006 Ha
2007/0146237 A1 6/2007 Lee
2008/0106544 A1* 5/2008 Lee et al. ..... 345/214
2009/0167639 A1 7/2009 Casner et al.

FOREIGN PATENT DOCUMENTS

JP 2005242604 9/2005
KR 2006-0040921 5/2006
KR 2006-0065277 6/2006
(Continued)

OTHER PUBLICATIONS

Machine translation of JP2005-242604 A (publication date Sep. 8, 2005) to English language.*
(Continued)

*Primary Examiner* — Quan-Zhen Wang
*Assistant Examiner* — David Lee
(74) *Attorney, Agent, or Firm* — Robert E. Bushnell, Esq.

(57) ABSTRACT

A digital display device that implements a digital photo frame function. The digital display device includes a user input unit to receive control signals corresponding to a user operation, the control signals to control a plurality of images to be continuously displayed, a display controller including an image arrangement unit, the display controller to output display signals by storing image files or processing the stored image files according to the control signals, a storage unit having image files stored therein and a display unit to display the plurality of images on a screen according to the display signals, the image arrangement unit to arrange the plurality of images in an arrangement order for display based on comparison results that compare data for pairs of images selected from the plurality of images upon the control signals being input.

7 Claims, 5 Drawing Sheets

(56) References Cited

FOREIGN PATENT DOCUMENTS

| | | |
|---|---|---|
| KR | 2007-0071650 | 7/2007 |
| KR | 2007-0088944 | 8/2007 |

OTHER PUBLICATIONS

Machine translation of KR 10-2006-0065277 (publication date Jun. 14, 2006) to English language.*

Korean Office Action issued by KIPO dated Jan. 27, 2011; corresponding to Korean Patent Application No. 10-2009-0070547, together with Request for Entry.

Korean Office action issued by Korean Patent Office on Jul. 31, 2011, corresponding to KR 10-2009-0070547 and Request for Entry attached herewith.

* cited by examiner

DIGITAL DISPLAY DEVICE AND IMAGE ARRANGEMENT METHOD USING THE SAME

CLAIM OF PRIORITY

This application makes reference to, incorporates the same herein, and claims all benefits accuring under 35 U.S.C §119 from an application earlier filed in the Korean Intellectual Property Office on 31 Jul. 2009 and there duly assigned Serial No. 10-2009-0070547.

BACKGROUND OF THE INVENTION

Field of the Invention

The present invention pertains to a digital display device that implements a digital photo frame function and an image arrangement method using the same.

Discussion of Related Art

With the recent advent of the electronic information era, various digital display devices have been developed that implement a digital photo frame function and replace conventional photos or pictures with modern electronic expressions to enable the display of the photos on a screen.

As the digital display devices that implements the digital photo frame function as described above, a digital camera, a digital frame that focuses on the digital photo frame function, etc. have been released.

The digital display device such as the digital frame, etc. has a flat display panel such as a liquid crystal display panel or an organic light emitting display panel, thereby displaying an image on a screen. Among others, the digital display device having the organic light emitting display device is advantageous in that it can be implemented to be thin using organic light emitting diodes that are self-light emitting elements that can display a clearer image.

Meanwhile, the digital display device such as the digital frame, etc. is designed to implement a slide function to continuously display a plurality of image files as well as a function to fixingly display one image file.

However, when images having the similar color groups are sequentially displayed in a digital frame on an organic light emitting display device, an image sticking (or residual image) phenomenon occurs causing the image quality to be degraded.

SUMMARY OF THE INVENTION

The present invention provides a digital display device that implements a digital photo frame function that is able to prevent an image sticking (or residual image) phenomenon from occurring and an image arrangement method using the same.

According to one aspect of the embodiment, there is provided a digital display device including a user input unit to receive control signals corresponding to a user operation, the control signals to control a plurality of images to be continuously displayed, a display controller including an image arrangement unit, the display controller to output display signals by storing image files or processing the stored image files according to the control signals, a storage unit having image files stored therein and a display unit to display the plurality of images on a screen according to the display signals, the image arrangement unit to arrange the plurality of images in an arrangement order for display based on comparison results that compare data for pairs of images selected from the plurality of images upon the control signals being input.

The image arrangement unit can compare the data for ones of the plurality of images and to can arrange a pair of images having most similar color groups among all possible pairs of images selected from the plurality of images to be displayed to have a longest time interval between a display of ones of said pair of images. The image arrangement unit can calculate data subtraction values for each pair of images selected from the plurality of images and can produce the arrangement order for display of the plurality of images based on the calculated data subtraction values. The image arrangement unit can calculate data subtraction values for every possible pair of images selected from the plurality of images and can arrange ones of a pair of images having the smallest data subtraction value to be displayed having with a maximal time interval therebetween.

The display controller can process the image files for the plurality of images in an order determined by the image arrangement unit and can transfer the display signals to the display unit. The image arrangement unit can include an operator to calculate data subtraction values for pairs of images and to form a plurality of subtraction value tables corresponding to the pairs of images, the data subtraction values being derived from ones of a plurality of data tables in which the respective data for ones of the plurality of images are stored, a comparator to compare the plurality of subtraction value tables and to arrange the subtraction value tables in an order corresponding to the comparison results and an order determination unit to determine an order that the plurality of images are to be displayed based on the arrangement order of the subtraction value tables. The operator can form the plurality of subtraction value tables for each possible combination of two images selected among the plurality of images. The order determination unit can arrange ones of two images having the smallest data subtraction values to be displayed as far apart temporally as possible.

According to another aspect of the present invention, there is provided a method of arranging a plurality of images for display in an order that minimizes image sticking, the method including selecting a plurality of images, forming a plurality of subtraction value tables from a plurality of data tables that represent the plurality of images, comparing the subtraction value tables, arranging the subtraction value tables in an arrangement order according to a predetermined basis according to the comparing and arranging the plurality of images according to the arrangement order of the subtraction value tables. The method can also include, between the selecting the plurality of images and the forming the plurality of subtraction value tables, forming the plurality of data tables by extracting RGB data per pixel for each of the plurality of images.

The forming the plurality of subtraction value tables can include calculating data subtraction values for every possible combination of two images selected from the plurality of images. In the arranging the subtraction value tables, the subtraction value tables can be arranged in order of increasing or decreasing data subtraction values. In the arranging the plurality of images, a pair of images having the smallest data subtraction values having ones of the images of said pair of images can be ordered in the arrangement order as far apart as possible from each other. In the arranging the plurality of images, a pair of images having the most similar color groups among all possible pairs of images of the plurality of images can be ordered in the arrangement order as far apart as possible from each other. The method can also include outputting and displaying the display signals by processing the image files for the plurality of images in the order arranged in the arranging the plurality of images.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
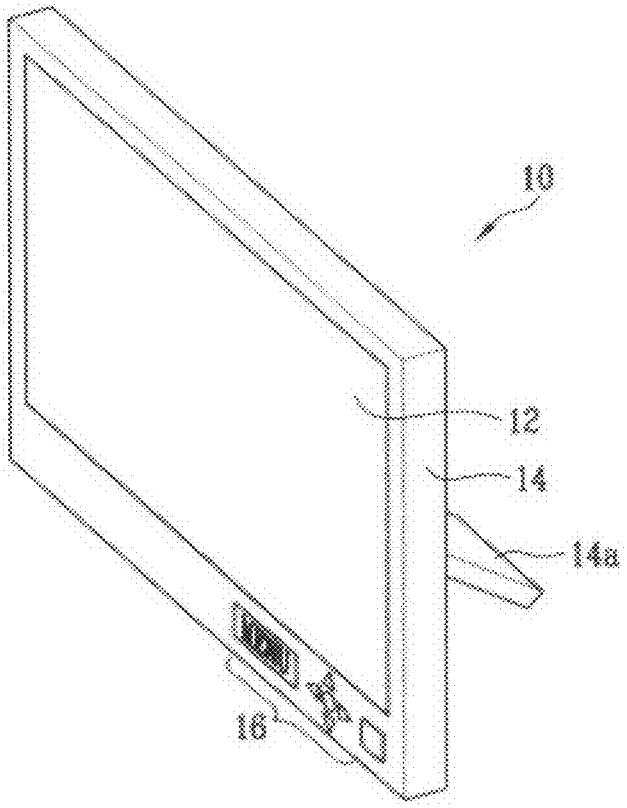
FIG. 1 is a perspective view showing one example of a digital display device that implements a digital photo frame function.

Hereinafter, certain exemplary embodiments according to the present invention will be described with reference to the accompanying drawings. Here, when a first element is described as being coupled to a second element, the first element can be not only directly coupled to the second element but can also be indirectly coupled to the second element via a third element. Further, some of the elements that are not essential to the complete understanding of the invention are omitted for clarity. Also, like reference numerals refer to like elements throughout.

Hereinafter, exemplary embodiments according to the embodiment will be described with reference to the accompanying drawings.

FIG. 1 is a perspective view showing one example of a digital display device that implements a digital photo frame function. For convenience of explanation, a digital frame is illustrated in FIG. 1 by way of example of the digital display device, but the embodiment is not limited to the digital frame.

Referring to FIG. 1, the digital display device 10 includes a flat display panel 12 that displays an image, a frame 14 on which the flat display panel 12 is mounted, and input buttons 16 that are exposed to the outside of the frame 14.

The flat display panel 12 can be implemented as a liquid crystal display panel or an organic light emitting display panel, etc., and, in particular, when the flat display panel 12 is implemented as the organic light emitting display panel, it can be designed to be thin, while being able to display a clearer image.

The frame 14 receives various control devices and a storage device that are not shown, including the flat display panel 12. Such a frame 14 can be coupled with supporter 14*a* that stably supports the digital display device 10, wherein the supporter 14*a* can be formed integrally with the frame 14 or can be formed separately to be engaged with the frame 14.

The input buttons 16 include various function buttons including menu buttons or direction keys, etc. and a power button to transfer a control signal by user operation to the digital display device 10.

The digital display device 10 as described above, which replaces conventional photos or pictures with modern electronic expressions to display them on a screen, is designed to implement a slide function to continuously display a plurality of image files as well as a function to fixingly display a single image file.

Figure 2:
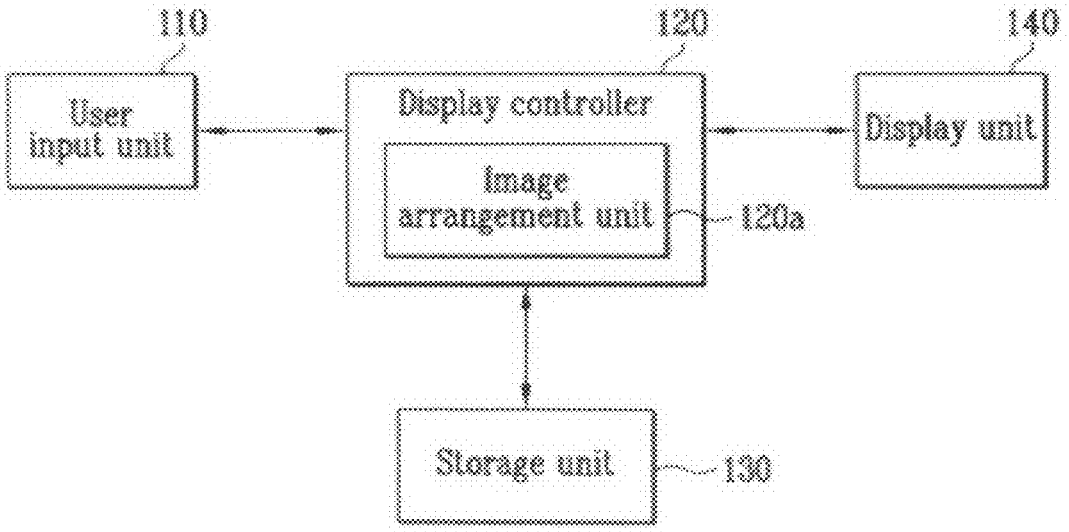
FIG. 2 is a block diagram showing a functional constitution of a digital display device according to an embodiment of the present invention.
Figure 3:
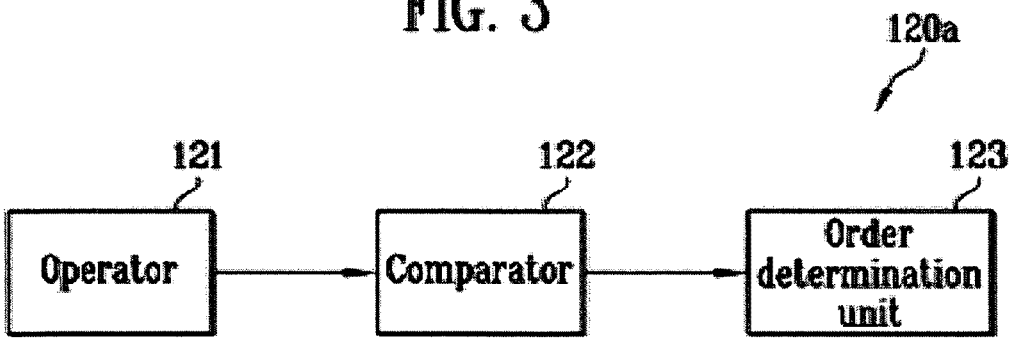
FIG. 3 is a block diagram showing one example of an image arrangement unit of FIG. 2.

Turning now to FIGS. 2 and 3, FIG. 2 is a block diagram showing a functional constitution of a digital display device according to an embodiment of the present invention and FIG. 3 is a block diagram showing one example of an image arrangement unit of FIG. 2.

Referring now to FIG. 2, the digital display device according to the embodiment of the present invention includes a user input unit 110, a display controller 120, a storage unit 130, and a display unit 140.

The user input unit 110 receives the control signal corresponding to user operation through an input button or a touch panel, etc. and transfers it to the display controller 120. The display controller 120 stores an image file in the storage unit 130 according to the control signal transferred from the user input unit 110 or processes a pre-stored image file to output a display signal to the display unit 140.

The display signal, which includes various signals required in displaying the image in the display unit 140, can include image data, a scan driving signal, a data driving signal, etc. by way of example. Alternately, when a scan driver and a data driver are not provided in the display unit 140 but are built-in the display controller 120, the display signal can include a scan signal or a data signal, etc.

The storage unit 130 has a memory element that stores the image file. Such a storage unit 130 can be designed to have sufficient capacity so that it can store data required in making a list or setting data required in driving the digital display device, etc., in addition to the image file.

The display unit 140, which displays the image on a screen according to the display signal supplied from the display controller 120, can be implemented as a liquid crystal display panel or an organic light emitting display panel, etc. In particular, when the display unit 140 is implemented as the organic light emitting display panel, it is advantageous in that it can be designed to be thin and can display a clearer image.

However, in the digital display device according to the embodiment of the present invention, when a plurality of images are continuously displayed, the display controller 120 prevents the images having similar color groups from being consecutively displayed, thereby preventing an image sticking (or residual image) phenomenon.

To this end, the display controller 120 has an image arrangement unit 120*a*. When the control signal that controls the plurality of images to be continuously displayed is input, the image arrangement unit 120*a* compares data for the plurality of images and determines a display order for the plurality of images according to the comparison results, so that the images having the similar color groups are not consecutively displayed.

For example, the image arrangement unit 120*a* can select two images having the most similar color group from among the plurality of images according to the comparison results obtained by comparing data for the plurality of images, and control the two images so that they are displayed with a long time interval therebetween.

In other words, when the plurality of images selected for displaying are displayed once in order in a slide manner, the image arrangement unit 120*a* can determine which the two images have the most similar color group and control the two images so that one of the two images is displayed first and the other is displayed last.

If the order for the plurality of images to be displayed is determined by the image arrangement unit 120*a*, the display controller 120 processes the image files for the plurality of images in the predetermined order to output the display signal to the display unit 140.

Then, the display unit 140 displays the plurality of images in order determined by the image arrangement unit 120*a*. Therefore, the images having similar color groups are prevented from being consecutively displayed on the screen, making it possible to prevent the image sticking phenomenon.

Hereinafter, the constitution and the operation of the image arrangement unit 120*a* will be described in more detail with reference to FIG. 3. Referring to FIG. 3, the image arrangement unit 120*a* includes an operator 121, a comparator 122, and an order determination unit 123.

When the control signal that controls the plurality of images selected by the user operation to be continuously displayed is input, the operator 121 refers to a plurality of data tables stored and having respective data of the selected plurality of images, calculates data subtraction values among the plurality of data tables, and forms a plurality of subtraction value tables corresponding thereto.

More specifically, the operator 121 calculates data subtraction values by subtracting the data tables of two images for every possible combination of two images selected from n plurality of images (n is a natural number of 3 or more), that is, for each of the number of all cases that are drawn from the combination ${}_nC_2$ and stores the calculated data subtraction values, thereby forming the plurality of subtraction value tables.

Meanwhile, when the data tables for one or more images among the plurality of images to be continuously displayed are not stored, the operator 121 stores the data per RGB pixels of the respective images not previously stored in the storage unit 130 before forming the subtraction value tables, thereby making it possible to form the data tables.

When the operator 121 does not serve to produce the data tables, a separate constituent implementing this can further be provided.

The comparator 122 compares the plurality of subtraction value tables and arranges the subtraction value tables in order corresponding to the comparison results.

For example, the comparator 122 can compare the average value of the data subtraction values stored in the subtraction value tables or the data subtraction values in a certain region, and arrange the subtraction value tables in ascending order or in descending order, according to the comparison results.

The order determination unit 123 determines the order that the plurality of images are to be displayed according to the arrangement order of the subtraction value tables. In particular, in the present invention, the order determination unit 123 arranges the two images that have the smallest data subtraction values or smallest difference in subtraction value tables to be displayed temporally as far apart from each other as possible in order to reduce the residual image effect from occurring due to the similarity of the two images. For example, the order determination unit 123 can allow ones of the two images used in forming the subtraction value table having the smallest data subtraction value to be arranged and displayed first and last on the slideshow. However, this is the case where they are arranged assuming that the plurality of images are once displayed, respectively. Therefore, when the plurality of images are displayed in a repetitive circulation structure, the two images can instead be arranged at the positions having the longest time interval between their display, such as one image at the beginning of the slide show and the other in the middle, so that the two images are not consecutively displayed upon recirculation.

Meanwhile, the feature that the data subtraction value is small means that the color difference between the two images is small so that the two images have the similar color groups. In other words, when the plurality of image files are continuously displayed in the slide manner, the image arrangement unit 120*a* of the present invention arranges the images so that the images having the similar color groups are not consecutively displayed.

Figure 4:
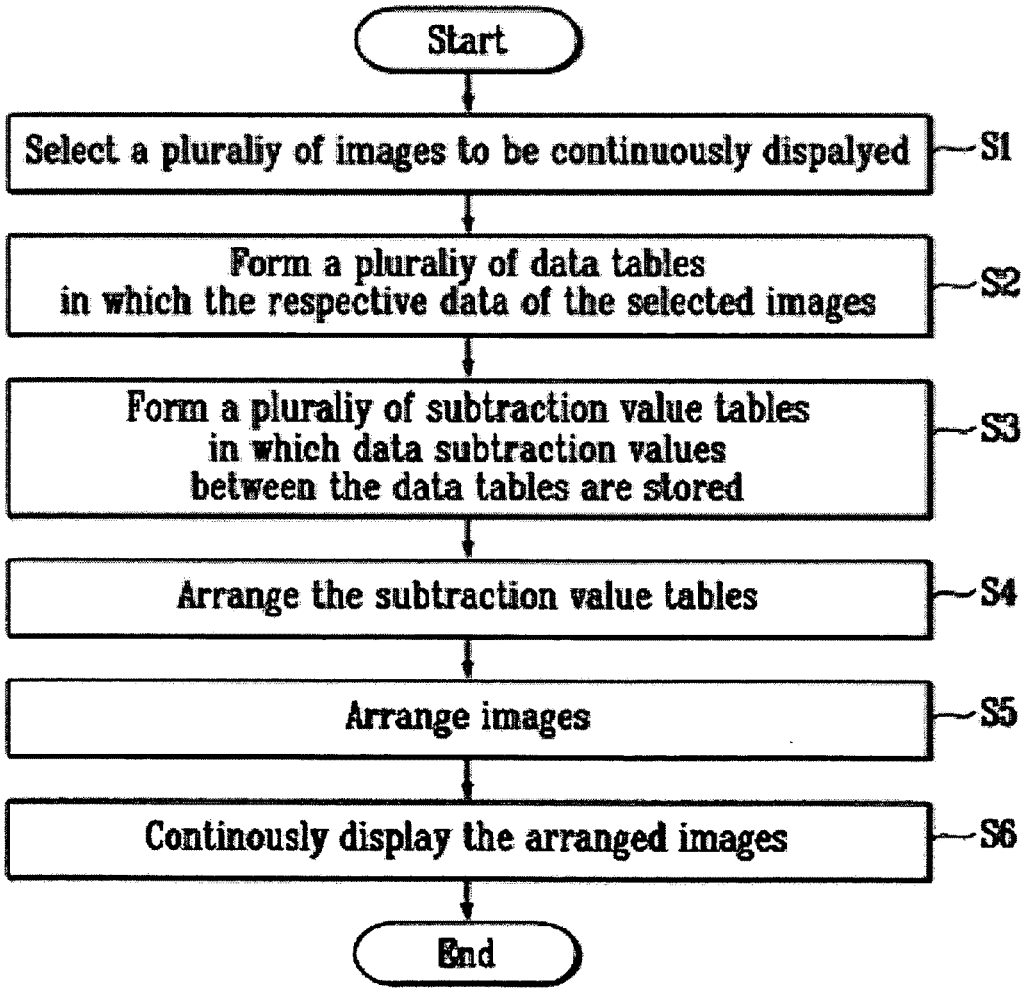
FIG. 4 is a flowchart showing a method to arrange a plurality of images to be continuously displayed in the digital display device according to the embodiment of the present invention.

Turning now to FIGS. 4 through 7, FIG. 4 is a flowchart showing a method to arrange an order for a plurality of images to be continuously displayed in the digital display device according to the embodiment of the present invention and FIGS. 5A to 7 are the drawings illustrating in detail ones of the steps shown in the flowchart of FIG. 4. Hereinafter, an image arrangement method of a digital display device according to an embodiment of the present invention will be described with reference to FIGS. 4 to 7.

Image selecting step (S1): First, a plurality of images that are to be continuously displayed are selected. The plurality of images can be directly searched or designated by a user or can be designated when the user selects all of the stored images or a fraction of the images to be displayed.

Data table forming step (S2): Thereafter, RGB data per pixel for the selected plurality of images are extracted to form a plurality of data tables. For convenience of explanation, it will be hereinafter assumed that four images of first to fourth images img1, img2, img3, and img4 are selected.

Figure 5A:
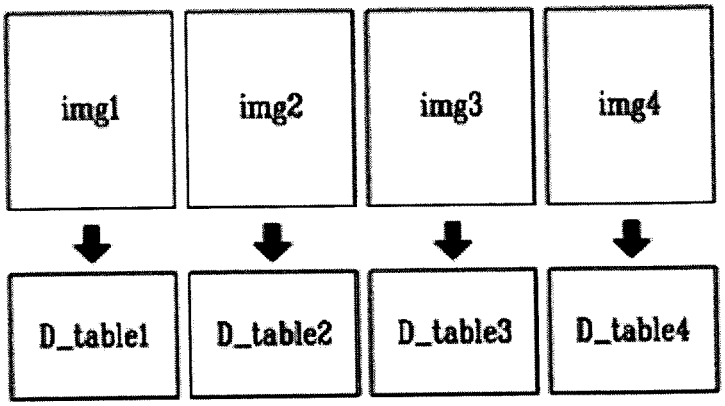
FIGS. 5A and 5B are diagrams showing a method to form data tables of each selected image.
Figure 5B:
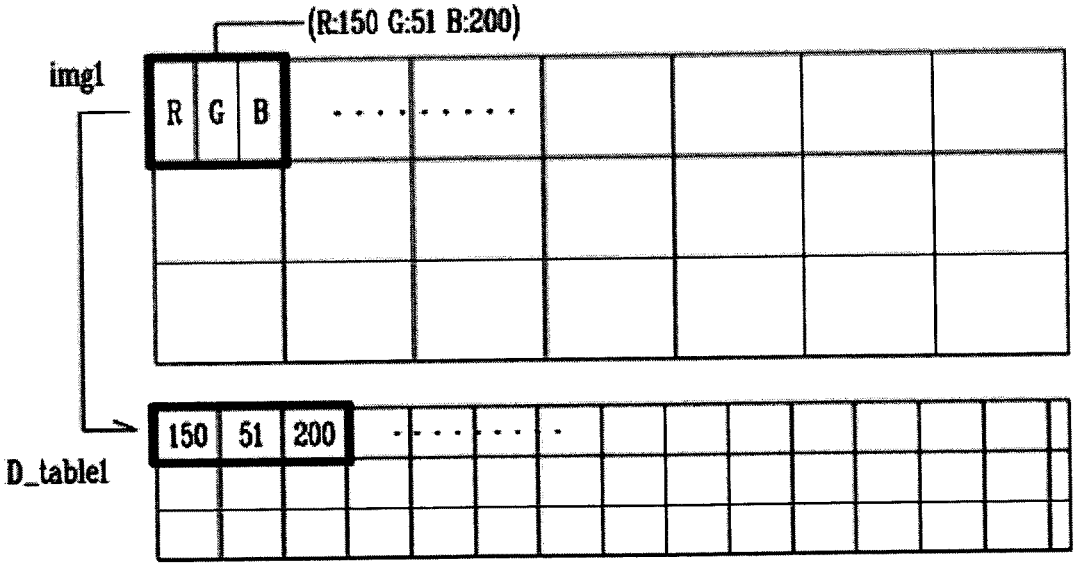

In this case, as shown in FIG. 5A, first to fourth data tables D_table1, D_table2, D_table3, and D_table 4 are formed by storing data corresponding to the respective first to fourth images img1, img2, img3, and img4, and as shown in FIG. 5B where the RGB data corresponding to the positions per pixel are extracted to be stored in the respective data tables, thereby completing the first to fourth data tables D_table1, D_table2, D_table3, and D_table 4.

For convenience of explanation, although the RGB data corresponding to the first pixel on the first image img1 is illustrated to be stored in the first data table D_table1 in FIG. 5B, the RGB data corresponding to other pixels of the first image img1 and the pixels of the second to fourth images img2 to img4 are stored in the data tables in the same manner. Thereby, the plurality of data tables D_table1, D_table2, D_table3, and D_table 4 in which the respective data of the first to fourth images img1, img2, img3, and img4 are formed. However, when the data table for one or more images of the selected plurality of images is previously stored, the data table forming step for the image where the data table is stored can be omitted.

Subtraction value table forming step (S3): Thereafter, a plurality of subtraction value tables are formed using the plurality of data tables previously formed and stored. At this time, the respective subtraction value tables are formed by calculating data subtraction values using the data tables for pairs of images of the plurality of images. A subtraction value table is produced for each combination of two images of the plurality of images. In the case of 4 images, since there are 6 possible combinations of two images, 6 subtraction value tables are produced.

Figure 6A:
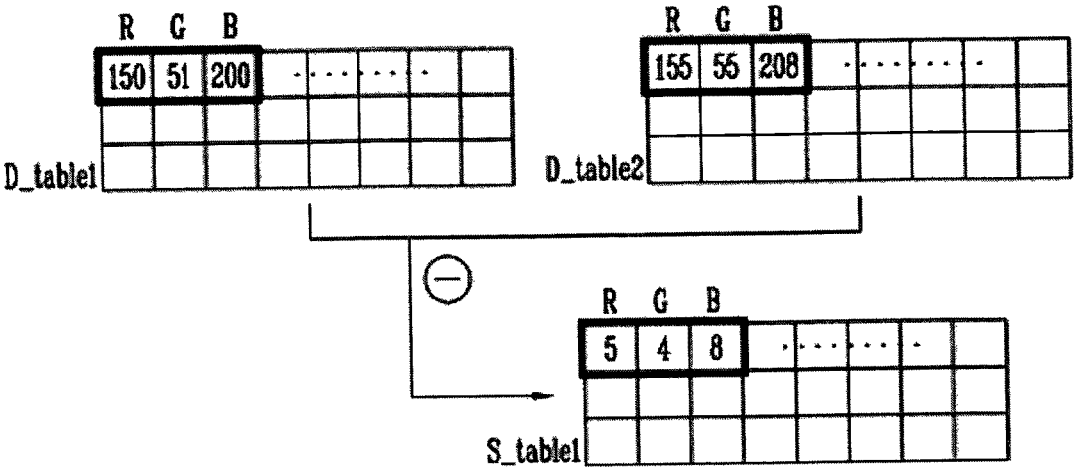
FIGS. 6A and 6B are diagrams showing a method to form a plurality of subtraction value tables from a plurality of data tables.
Figure 6B:
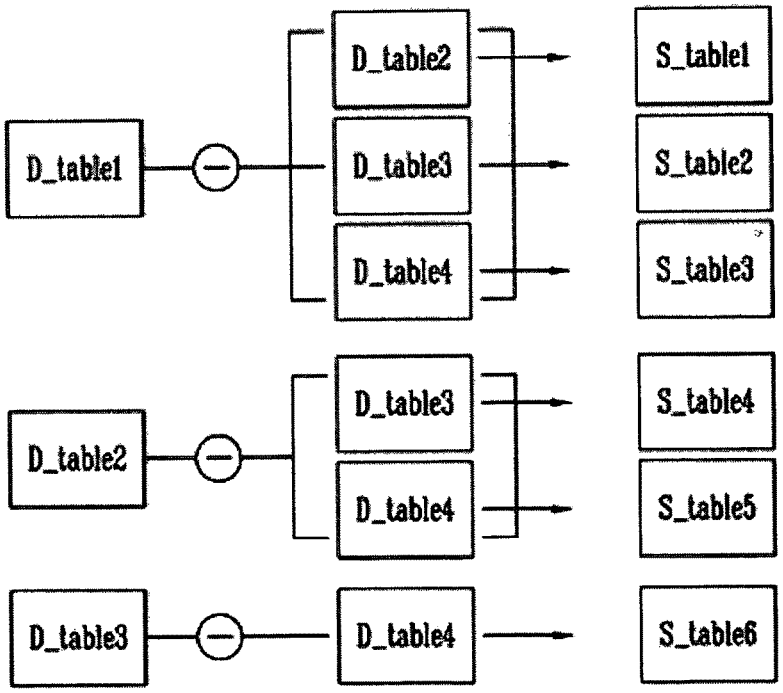

For example, as shown in FIG. 6A, the RGB data subtraction values per pixel are calculated using the first data table D_table1 for the first image img1 and the second data table D_table2 for the second image img2, thereby making it possible to form a first subtraction value table S_table1. Herein, the RGB data subtraction values per pixel can be obtained by matching and finding the difference of the RGB data values corresponding to the respective same matrix numbers of the first data table D_table1 and the second data table D_table2. This procedure is repeated for each combination of two images of the plurality of images, which, in the case of four images, is six subtraction value tables. Therefore, first to sixth subtraction value tables S_table1, S_table2, S_table3, S_table3, S_table4, S_table5, and S_table6 are formed from the first to fourth data tables D_table1, D_table2, D_table3, and D_table4 for the respective first to fourth images img1, img2, img3, and img4.

Subtraction value table arranging step (S4): Thereafter, the formed subtraction value tables are compared and the subtraction value tables are arranged in order according to the predetermined basis based on the comparison results. At this time, the basis that arranges the subtraction value tables can be increasing or decreasing data subtraction values. Alternately, the basis can be set variously by providing the average value of the RGB data subtraction values per pixel stored in the subtraction value tables or the average value or the weight in a certain region, etc.

Figure 7:
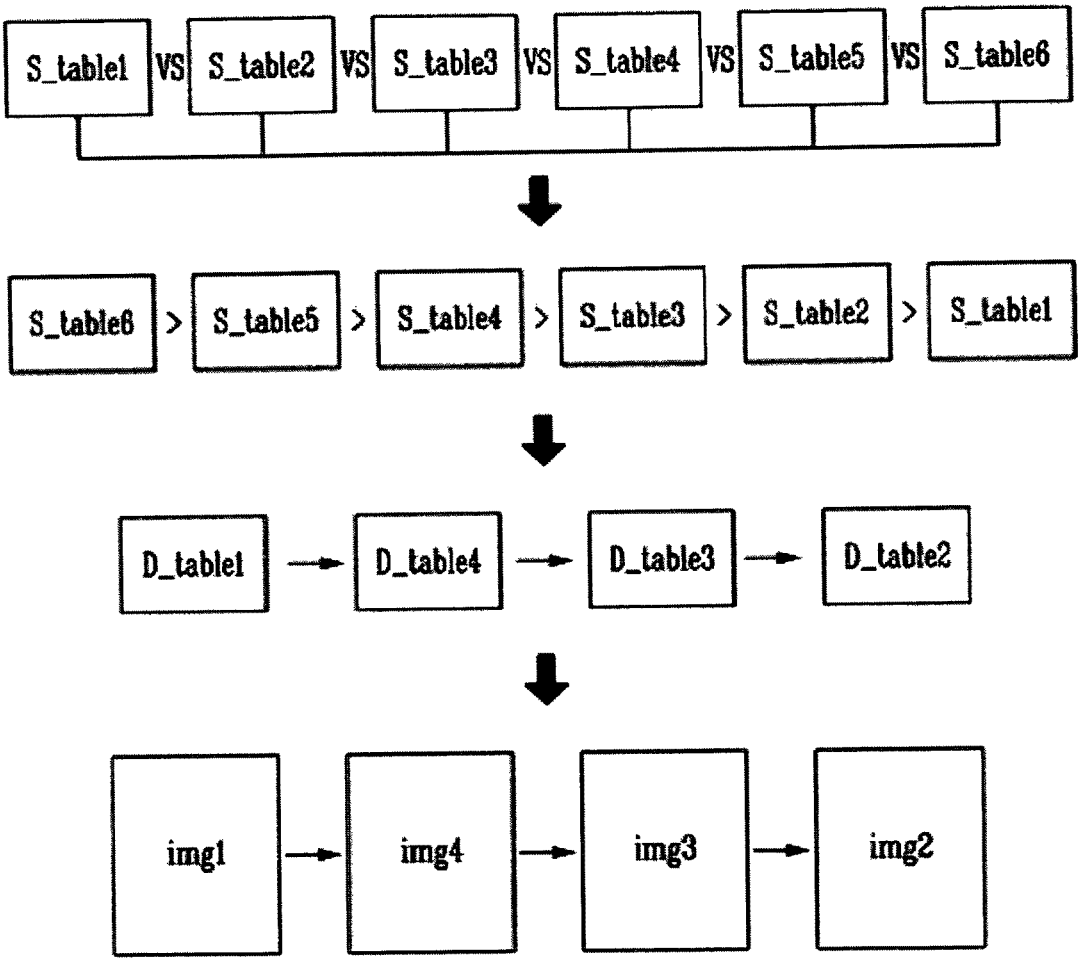
FIG. 7 is a diagram sequentially showing a method to compare the plurality of subtraction value tables and to arrange the images in an order for display using the comparison results.

For example, as shown in FIG. 7, the first to sixth subtraction value tables S_table1. S_table2, S_table3, S_table4, S_table5, and S_table6 can be compared and the data subtraction values can be arranged according decreasing data subtraction values. For convenience of explanation, assuming that the data subtraction values become small in sequence from the sixth subtraction value table S_table6 to the first subtraction value table S_table1, the subtraction value tables are arranged in order from the sixth subtraction value table S_table6 to the first subtraction value table S_table1.

Image arranging step (S5): Thereafter, the plurality of images are arranged according to the arrangement order of the subtraction value tables. In this step, the two images used to produce the subtraction value table having the smallest data subtraction value are displayed as far apart temporally as possible.

For example, when the data subtraction value of the first subtraction value table S_table1 is the smallest, the first data table S_table1 or first image and the second data table S_table2 or second image used in forming the first subtraction value table S_table1 is arranged to be displayed as far apart temporally as possible in the display sequence.

In other words, if the first data table D_table1 is arranged first, the second data table S_table2 can be arranged last, provided that the images are not displayed in a repetitive circulation structure. Alternatively, the order of the first data table D_table1 and the second data table D_table2 can be reversed, wherein this can be set variously based on an image previously designated by a user, an image positioned on an upper list of a file list, etc.

If the first data table D_table1 is arranged first and the second data table D_table2 is arranged last, the third data table D_table3 and the fourth data table D_table4 can be arranged therebetween. At this time, the data subtraction value of the third subtraction value table S_table3 is larger than the subtraction value of the second subtraction value table S_table2 so that the fourth data table D_table4 can be arranged following the first data table D_table1.

In other words, the data tables are arranged in order of the first data table D_table1, the fourth data table D_table4, the third data table D_table3, and the second data table D_table2. This order corresponds to the order of the images, wherein the images are arranged in order of the first image img1, the fourth image img4, the third image img3, and the second image img2. This ordering of images minimizes the residual image phenomenon by preventing two like images from being displayed consecutively. Therefore, the two images having the most similar color groups among the plurality of images, for example, the first image img1 and the second image img2, are arranged to have the longest time interval in between.

Displaying step (S6): Thereafter, the image files for the plurality of images are processed in the order arranged in the image arranging step to output display signals, and accordingly, the arranged images are continuously displayed on a screen in a slide manner.

With the embodiment as described above, the digital photo frame function is implemented using the digital display device, but when the plurality of image files are continuously displayed, the images can be arranged so that the images having the similar color groups are not consecutively displayed. In other words, the embodiment prevents the same color-based images from being continuously displayed and slides the images having the relatively different color groups to be displayed sequentially, making it possible to prevent an image sticking phenomenon.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An image arrangement method, comprising:

selecting a plurality of images;

forming a plurality of subtraction value tables from a plurality of data tables that represent the plurality of images, wherein each of said subtraction value tables includes data representative of a difference in RGB data values for each pixel for two of the plurality of images;

comparing the subtraction value tables;

arranging the subtraction value tables in an arrangement order according to a predetermined basis according to the comparing; and arranging the plurality of images according to the arrangement order of the subtraction value tables.

2. The method of claim 1, further comprising, between the selecting the plurality of images and the forming the plurality of subtraction value tables:

forming the plurality of data tables by extracting RGB data per pixel for each of the plurality of images.

3. The method of claim 1, wherein the forming the plurality of subtraction value tables comprises calculating data subtraction values for every possible combination of two images selected from the plurality of images.

4. The method of claim 3, wherein in the arranging the subtraction value tables, the subtraction value tables are arranged in order of increasing or decreasing data subtraction values.

5. The method of claim 3, wherein in the arranging the plurality of images, a pair of images having the smallest data subtraction values having ones of the images of said pair of images being ordered in the arrangement order as far apart as possible from each other.

6. The method of claim 1, wherein in the arranging the plurality of images, a pair of images having the most similar color groups among all possible pairs of images of the plurality of images are ordered in the arrangement order as far apart as possible from each other.

7. The method of claim 1, further comprising outputting and displaying the display signals by processing the image files for the plurality of images in the order arranged in the arranging the plurality of images.

* * * * *